US005709241A

United States Patent [19]

Iwata

[11] Patent Number: 5,709,241

[45] Date of Patent: Jan. 20, 1998

[54] BUTTERFLY VALVE

[75] Inventor: Minoru Iwata, Susono, Japan

[73] Assignee: Toyota Jidosha Kabushiki Kaisha, Aichi, Japan

[21] Appl. No.: 582,796

[22] Filed: Jan. 4, 1996

[30] Foreign Application Priority Data

Jan. 9, 1995 [JP] Japan ..... 7-001318

[51] Int. Cl.[6] ..... F16K 15/03; F01N 1/08

[52] U.S. Cl. ..... 137/527.6; 137/527; 181/226

[58] Field of Search ..... 137/527, 527.6, 137/527.8; 181/226, 227, 228

[56] References Cited

U.S. PATENT DOCUMENTS

| | | | |
|---|---|---|---|
| 386,461 | 7/1888 | Goll | 137/527 |
| 1,330,265 | 2/1920 | Hinton | 137/527 |
| 3,274,917 | 9/1966 | Tolbert, Sr. | 137/527.6 X |
| 3,327,732 | 6/1967 | Deve | 137/527.8 X |
| 3,352,318 | 11/1967 | Yanowitz | 137/527.8 X |
| 4,609,068 | 9/1986 | Backlund | 181/226 |
| 4,699,244 | 10/1987 | Bergluist et al. | 181/226 |
| 5,355,673 | 10/1994 | Sterling et al. | 137/527 |

FOREIGN PATENT DOCUMENTS

| | | | |
|---|---|---|---|
| 56-54242 | 5/1981 | Japan . | |
| 56-142241 | 10/1981 | Japan . | |
| 5-156920 | 6/1993 | Japan . | |
| 6-248929 | 9/1994 | Japan . | |
| 7407967 | 1/1975 | Netherlands | 137/527.8 |
| 0859735 | 9/1981 | U.S.S.R. | 137/527.6 |

*Primary Examiner*—John Rivell
*Attorney, Agent, or Firm*—Kenyon & Kenyon

[57] ABSTRACT

A butterfly valve adapted to be arranged in a pipe through which fluid can flow, the pipe having an axis and an outlet end, the valve comprising a valve shaft having an axis eccentric to the pipe axis, and a valve element integrally supported by the valve shaft. The valve is opened by a fluid pressure acting on the valve element. A part of the valve element on one side of the valve shaft has a tip portion bent along a pleat line substantially parallel to the shaft axis toward the upstream side of a fluid flow. The valve is arranged at the outlet end of the pipe to form a clearance between the valve element part around the pleat line and the outlet end of the pipe, to thereby allow the fluid to flow out through the clearance, when the valve opens from a closed position thereof.

19 Claims, 7 Drawing Sheets

BUTTERFLY VALVE

BACKGROUND OF THE INVENTION

1. Field of the Invention

The present invention relates to a butterfly valve.

2. Description of the Related Art

Japanese Unexamined Patent Publication No. 5-156920 discloses a silencer or a muffler, for an engine, having expansion chambers connected in series via connection pipes. In this silencer, exhaust gas from the engine is, first, introduced into one of the expansion chambers, and is then introduced into the remaining chambers, one after another, via the connection pipes. Then, the exhaust gas is exhausted to the outside air.

The silencer further has a bypass pipe connecting two of the chambers each other and bypassing the connection pipe. In the bypass pipe, a butterfly valve is arranged. The butterfly valve has a valve shaft having an axis eccentric to the pipe axis and a valve element integrally supported by the valve shaft. The valve is opened by exhaust gas pressure acting on the valve element.

In this silencer, the valve is kept closed when the exhaust gas pressure is relatively low. As a result, the exhaust gas flows through the expansion chambers in turn, via the connection pipes. The flow area of each connection pipe is small, and that of each expansion chamber is large. Therefore, the flow area for the exhaust gas is quickly increased. This results in reducing an undesirable booming noise.

When the exhaust gas pressure becomes higher, the valve is opened. Therefore, a part of the exhaust gas introduced into the silencer is exhausted to the outside air via the bypass pipe. The flow area of the bypass pipe is larger than that of each connection pipe. Therefore, exhausting the exhaust gas via the bypass pipe avoids increasing the back pressure to the engine, to thereby ensure a larger output power from the engine.

In such a butterfly valve, the valve is kept opened by the dynamic pressure of the exhaust gas acting on the valve element. However, since the valve element mentioned above has a substantially flat configuration, an angle formed by the valve element and the exhaust gas flow becomes smaller as an opening of the butterfly valve becomes larger. Accordingly, a problem arises that a valve opening force due to the dynamic pressure of the exhaust gas does not become larger and the maximum opening of the valve also does not become larger, even when the exhaust gas pressure increases. If the maximum opening of the valve does not become larger, a flow resistance of the butterfly valve increases, to thereby increase the back pressure on the engine. This makes it difficult to ensure the larger engine output power.

To solve this problem, the silencer may be provided with a butterfly valve having a tip portion formed in a valve element part positioned on one side of the valve shaft, the tip portion being bent along a pleat line substantially parallel to the valve shaft, toward the upstream side of the gas flow. In such a butterfly valve, an angle formed by the tip portion and the gas flow is kept relatively larger, when the opening of the valve becomes larger, to thereby make the valve opening larger due to the dynamic pressure of the exhaust gas. However, when the exhaust gas pressure increases quickly due to, for example, a large change in the engine operating state, the gas pressure acting on the valve element with the tip portion increases quickly.

In this condition, if the valve is arranged away from an outlet end of the pipe, the exhaust gas flows through a clearance formed between the inner wall of the pipe and the edges of the valve element. This results in increasing a static pressure difference between the upstream and the downstream of the valve, when the exhaust gas pressure increases quickly. This large static pressure difference opens the valve much too quickly. However, if the valve opens too quickly, the valve element may collide with the pipe wall, to thereby make an undesirable noise, or to be broken. In particular, when the butterfly valve of this type is used with a silencer for an engine, if the valve opens too quickly, the back pressure on the engine may change very quickly to thereby change the engine output power suddenly. As a result, the drivability of the vehicle may deteriorate.

SUMMARY OF THE INVENTION

An object of the present invention is to provide a butterfly valve which has a low flow resistance and which does not open too quickly when the gas pressure suddenly increases.

According to the present invention, there is provided a butterfly valve adapted to be arranged in a pipe through which fluid can flow, the pipe having an axis and an outlet end, the valve comprising: a valve shaft having an axis eccentric to the pipe axis; and a valve element integrally supported by the valve shaft, wherein the valve is opened by a fluid pressure acting on the valve element, wherein a part of the valve element on one side of the valve shaft has a tip portion bent along a pleat line substantially parallel to the shaft axis toward an upstream side of a fluid flow, and wherein the valve is arranged at the outlet end of the pipe to form a clearance between the valve element part around the pleat line and the outlet end of the pipe, to thereby allow the fluid to flow out through the clearance, when the valve opens from a closed position thereof.

The present invention may be more fully understood from the description of preferred embodiments of the invention set forth below, together with the accompanying drawings.

DESCRIPTION OF THE PREFERRED EMBODIMENTS

Figure 1:
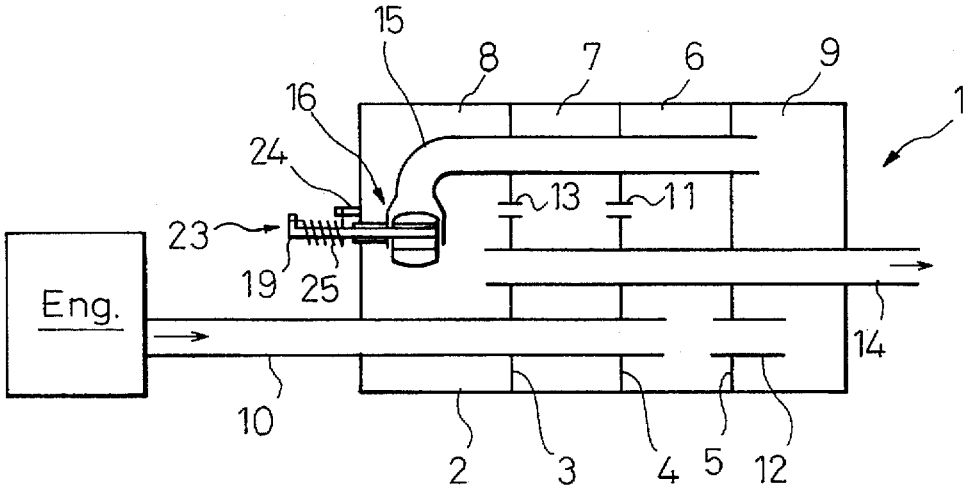
FIG. 1 is a general view of a silencer and an engine.

FIG. 1 shows an embodiment in which a butterfly valve according to the present invention is applied to a silencer for an engine. However, the valve according to the present invention can be used for other applications.

Referring to FIG. 1, a silencer or muffler 1 comprises a generally cylindrical housing 2. In the housing 2, first, second, and third defining walls 4, 5, and 6, substantially parallel to each other, are attached. These walls 3–5 define, in the interior of the housing, a first expansion chamber 6, a second expansion chamber 7, a third expansion chamber 8, and a resonance chamber 9. In the first chamber 6, an outlet of an introducing pipe 10 is opened. The introducing pipe 10 is connected to an engine 50 to introduce an exhaust gas of the engine 50 into the silencer 1. The first chamber 6 is connected to the second chamber 7 via a connection pipe 11 arranged in the second wall 4, and to the resonance chamber 9 via a resonance pipe 12 arranged in the third wall 5. The second chamber 7 is connected to the third chamber 8 via a connection pipe 13 arranged in the first wall 3. The third chamber 8 is connected to the atmosphere via an exhaust pipe 14. Namely, the chambers 6, 7, and 8 are connected in series.

Figure 2:
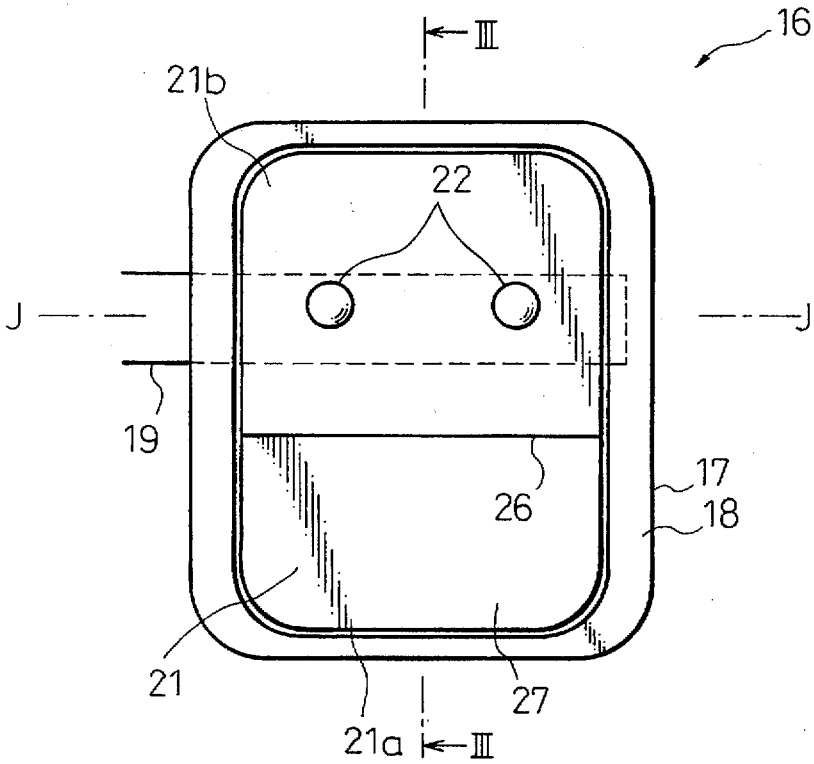
FIG. 2 is a back view of a butterfly valve.
Figure 3:
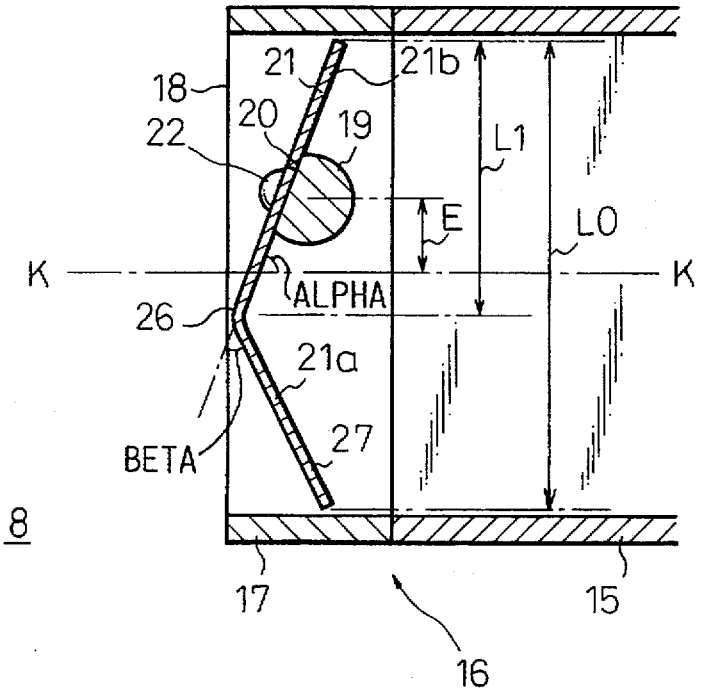
FIG. 3 is a sectional view of the butterfly valve, taken along a line III—III in FIG. 2.

As shown in FIG. 1, a bypass pipe 15 is provided, within the housing 2, to connect the resonance chamber 9 and the third chamber 8 to each other, bypassing the first and the second chambers 6 and 7. A butterfly valve 16 is arranged at an outlet end of the bypass pipe 15 positioned in the third chamber 8. When the valve 16 opens, the exhaust gas in the resonance chamber 9 flows into the third chamber 8 through the bypass pipe 15. In this embodiment, the butterfly valve 16 comprises a valve body 17 attached to the outlet end of the bypass pipe 15, as shown in FIGS. 2 and 3. Thus, the outlet end surface 18 of the valve body 17 acts as the end of the bypass pipe 15.

As shown in FIGS. 2 and 3, a valve shaft 19 of the butterfly valve 16 is arranged eccentric to an axis of the bypass pipe 15 K—K. Note that the valve body 17 has an axis common to that of the bypass pipe 15. Namely, an axis J—J of the valve shaft 19 is eccentric to the pipe axis K—K, by a distance E, upwardly (the direction as indicated in the drawings). Also, the valve shaft 19 is supported by the valve body 17 to rotate around the shaft axis J—J. The valve shaft 19 includes a flat portion 20, on which a valve element 21 is integrally fixed by, for example, rivets 22. The valve element 21 is fixed to form an angle ALPHA with the pipe axis K—K, when the valve 16 is in a closed position thereof.

Again, referring to FIG. 1, the valve shaft 19 extends outside of the housing 2, and is connected to a biassing device 23 provided outside of the housing 2. The biassing device 23 always biases the valve 16 toward the closed position thereof. In the embodiment shown, the biassing device 3 comprises a pin member 24 fixed to the housing 2, and a coiled spring 25, one end of which is fixed to the pin member 24 and the other end of which is fixed to the valve shaft 19.

Again, referring to FIGS. 2 and 3, a valve element part positioned the pipe axis K—K side with respect to the valve shaft 19, namely, positioned in a bottom side of the valve shaft 19 in FIG. 3, is referred as a bottom part 21*a*, hereinafter. A valve element part positioned opposite to the bottom part 21*a* with respect to the valve shaft 19, namely, positioned in a top side of the valve shaft 19 in FIG. 3, is hereinafter referred as a top part 21*b*. The bottom part 21*a* has a tip portion 27 bent along a pleat line 26 substantially parallel to the shaft axis J—J, toward the upstream side of the exhaust gas flow, by an angle BETA. The pleat line 26 is arranged at a position in which a projected distance from a top edge of the valve element 21 is L1.

Note that, in this embodiment, the tip portion 27 is formed by bending the valve element 21 in the form of the plate. Namely, the tip portion 27 and the valve element 21 are formed in one piece. However, the tip portion 27 and the valve element 21 may be formed separately, and then fixed integrally. Next, an operation of the silencer 1 shown in FIG. 1 will be explained, with reference to FIGS. 3 and 4A through 4C.

First, the silencer operation when the exhaust gas pressure is low will be explained. When the exhaust gas pressure is low, the pressure in the resonance chamber 9 is also low, and a valve opening force of a static pressure acting on the valve element 21 of the butterfly valve 16 is smaller than a valve closing force of the coiled spring 25. Accordingly, the valve 16 is kept closed, as shown in FIG. 3. As a result, the exhaust gas flowing through the introducing pipe 10 into the first expansion chamber 6 then flows into, in turn, the second and third expansion chambers 7 and 8, via the connection pipes 11 and 13. The flow area of each connection pipe 11, 13 is relatively small, and the that of each expansion chamber 6, 7, 8 is relatively large. Therefore, the exhaust gas flowing out from the connection pipes 11, 13 expands in the expansion chambers 7 and 8. This results in reducing an undesirable booming noise. Further, the undesirable noise due to the exhaust gas is further reduced by the resonance chamber 9 connected to the first expansion chamber 6. The exhaust gas in the third expansion chamber 8 is exhausted to the outside air via the exhaust pipe 14.

When the gas pressure increases and thereby the valve opening force due to the static pressure acting on the valve element 21 becomes larger than the valve closing force due to the spring 25, the butterfly valve 16 opens. When the valve 16 opens, the exhaust gas in the resonance chamber 9 flows through the bypass pipe 15. This prevents increasing the back pressure of the engine when the exhaust gas pressure increases, and thereby ensures a larger engine output power. Note that the valve 16 is kept opened by a dynamic pressure of the exhaust gas acting on the bottom part 21*a* of the valve element 21.

The butterfly valve 16 in this embodiment does not require a means for driving the valve, such as an actuator of an electrical or mechanical type. Therefore, the silencer 1 can be produced at a low cost and easily.

Figure 4A:
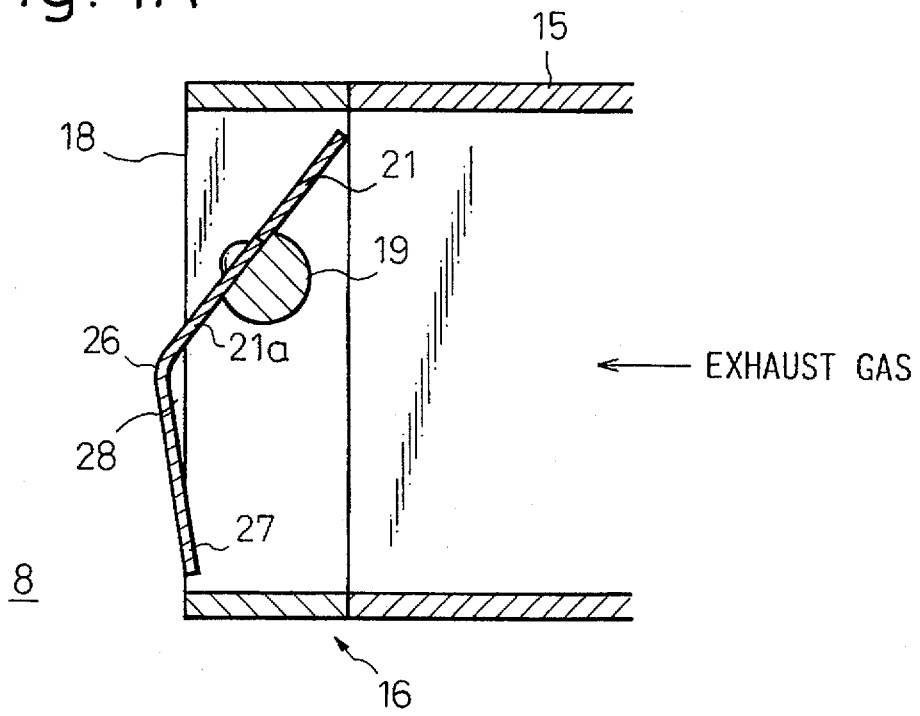
FIGS. 4A through 4C show an operation of the butterfly valve.

FIG. 4A shows the butterfly valve 16 when the valve opens slightly from the closed position. When the opening of the valve 16 is made a small opening as shown in FIG. 4A, two clearances 28 are formed between the bottom part 21*a* around of the pleat line 26 and the outlet end surface 18, at the both sides of the bottom part 21*a*, through which clearances the exhaust gas in the bypass pipe flows into the third expansion chamber 8. Further, when the valve 16 opens, the static pressure difference between the upstream and the downstream of the valve 16 rapidly reduces, since the valve 16 is arranged in the outlet end of the bypass pipe 15.

Figure 4B:
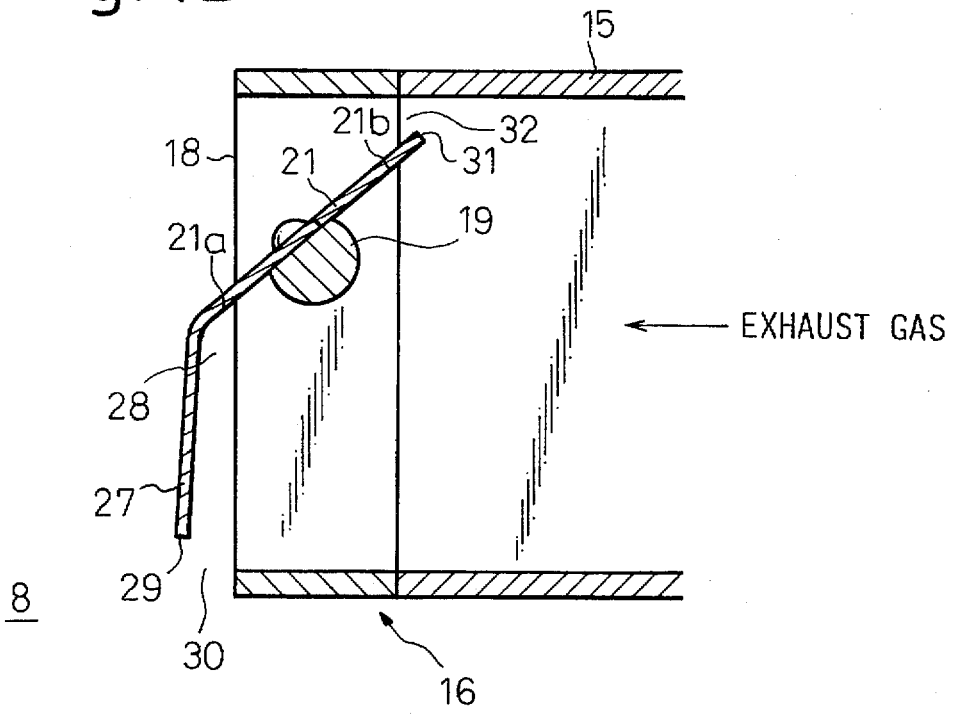
Figure 4C:
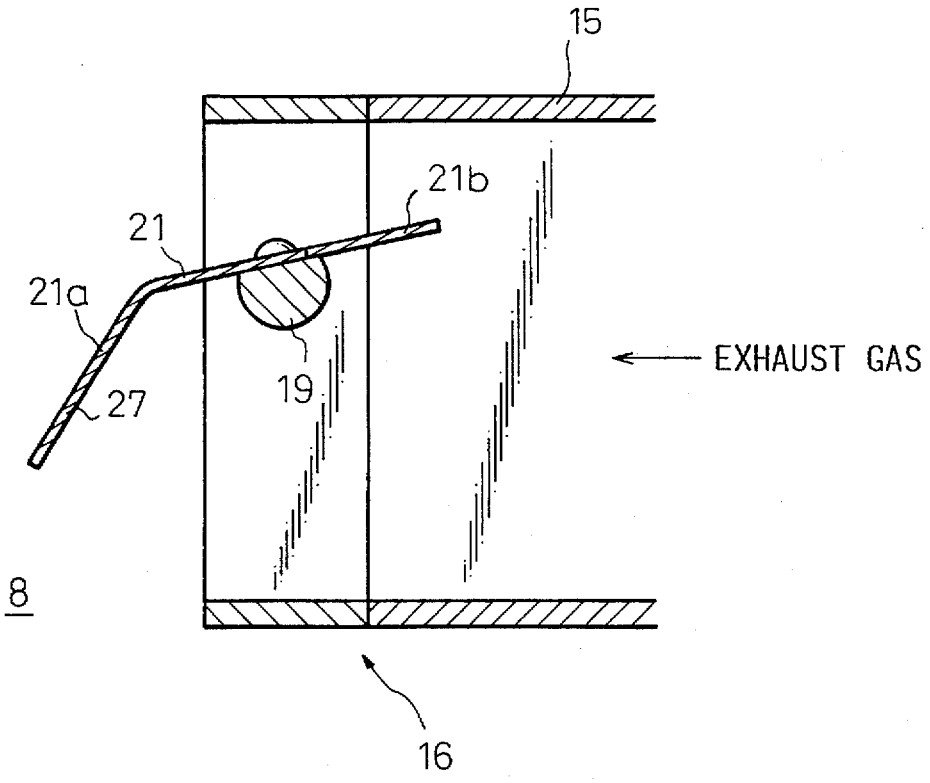

When the gas pressure further increases, the opening of the butterfly valve 16 further increases to a medium opening, as shown in FIG. 4B. In this condition, a further clearance 30 is formed between an edge of the bottom part 21*a* and the outlet end surface 18, through which clearance the exhaust gas flows out. The clearance 32 formed between an edge 31 of the top part 21*b* and the inner wall of the bypass pipe 15 is also enlarged.

Figure 5:
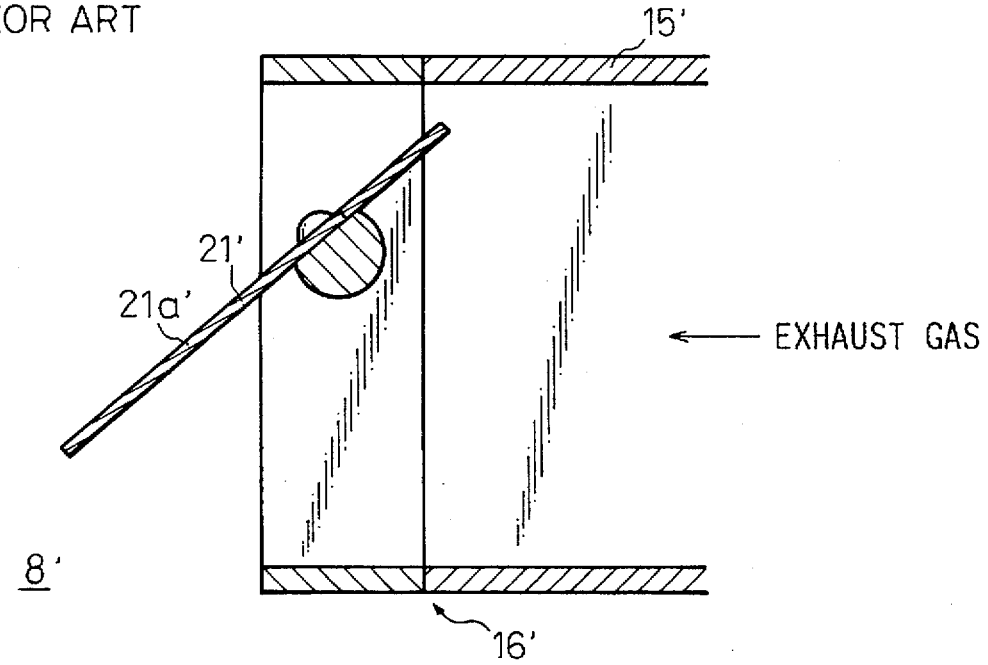
Fig.5 PRIOR ART
FIG. 5 illustrates a butterfly valve according to the prior art.

FIG. 5 illustrates a butterfly valve 16' according to the prior art, in which the bottom part 21*a'* of the valve 16' has no tip portion as in the preferred embodiment, but has a flat surface. In this valve 16' when the valve opening becomes that as shown in FIG. 5, the angle formed by the valve element 21' and the exhaust gas flow becomes smaller. In this condition, the valve opening force acting on the bottom part 21*a'* does not increase, even if the exhaust gas pressure increases. As a result, the valve opening of the valve 16' shown in FIG. 5 is limited up to that shown in FIG. 5. Namely, FIG. 5 shows a maximum opening of the valve 16'. Therefore, the flow resistance of the valve 16' prevents the exhaust gas flowing smoothly. This results in increasing the back pressure of the engine, and prevents ensuring a larger engine output power.

Contrarily, in the embodiment according to the present invention, the angle formed by the tip portion 27 and the exhaust gas flow is kept relatively large, even when the valve opening is as shown in FIG. 4B. Thus, the relatively large opening force due to the dynamic pressure of the exhaust gas keeps acting on the bottom part 21*a*. As a result, when the exhaust gas pressure increases from that shown in FIG. 4B, the valve opening increases to that shown in FIG. 4C. Namely, the maximum opening of the valve 16 is increased. Accordingly, the back pressure on the engine is prevented from increasing, to thereby ensure a larger engine output power.

Figure 6:
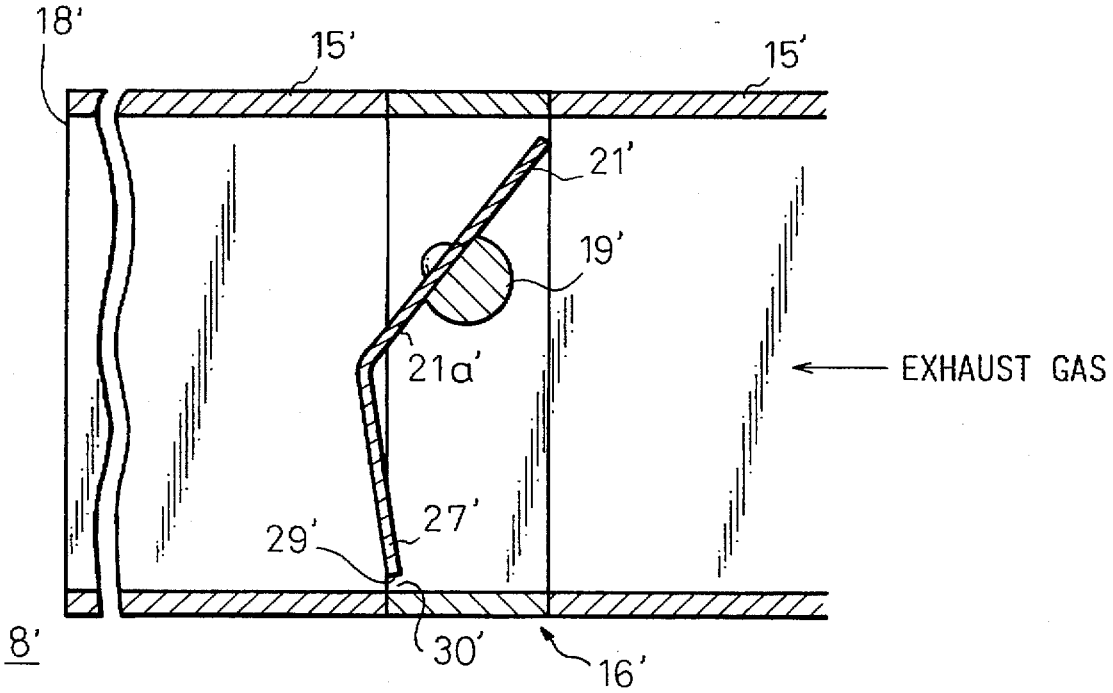
FIG. 6 illustrates a butterfly valve according to an undesirable example.

FIG. 6 illustrates an undesirable example, in which the bottom part 21*a'* of the valve element 21' has the tip portion 27', as in the preferred embodiment. Therefore, the valve opening force due to the dynamic pressure of the exhaust gas acting on the valve element 21' with the tip portion 27' may be large. Accordingly, when the exhaust gas pressure increases quickly due to the large change in an engine operating state, the valve 16' is forced to be opened quickly because of the large increase in the valve opening force.

However, the butterfly valve 16' is arranged in the bypass pipe 15' apart from the outlet end surface 18', as shown in FIG. 6. Therefore, a majority of the exhaust gas flowing in the bypass pipe 15' flows out through the clearance 30' formed between the edge 29' of the bottom element part 21*a'* and the inner surface of the bypass pipe 15'. Therefore, it requires a some time until the static pressure difference between the upstream and the downstream of the bypass pipe 16' becomes smaller. As a result, the valve 16' is forced to be opened too quickly, by the static pressure.

However, if the butterfly valve 16' opens too quickly, the valve element 21' may collide with the wall of the bypass pipe 15', to thereby make an undesirable noise, or to thereby be broken. In particular, when such a butterfly valve is used with the silencer for the engine, if the valve 16' opens too quickly, the back pressure of the engine may change quickly to thereby change in the engine output power quickly. As a result, the drivability of the vehicle, or the silencing characteristics of the silencer, may deteriorate.

To solve this problem, the present embodiment arranges the butterfly valve 16 adjacent to the outlet end surface 18. As a result, the upstream side of the valve 16 communicates, via the clearances 28, with the third expansion chamber 8 having a larger volume, even when the valve opening is small. This results in reducing the static pressure difference between the upstream and the downstream of the valve 16 rapidly. Accordingly, the valve is prevented from being opened too quickly, when the exhaust gas pressure increases quickly.

Next, a construction of the butterfly valve 16 will be explained in more detail, with reference to FIGS. 3 and 7.

Figure 7:
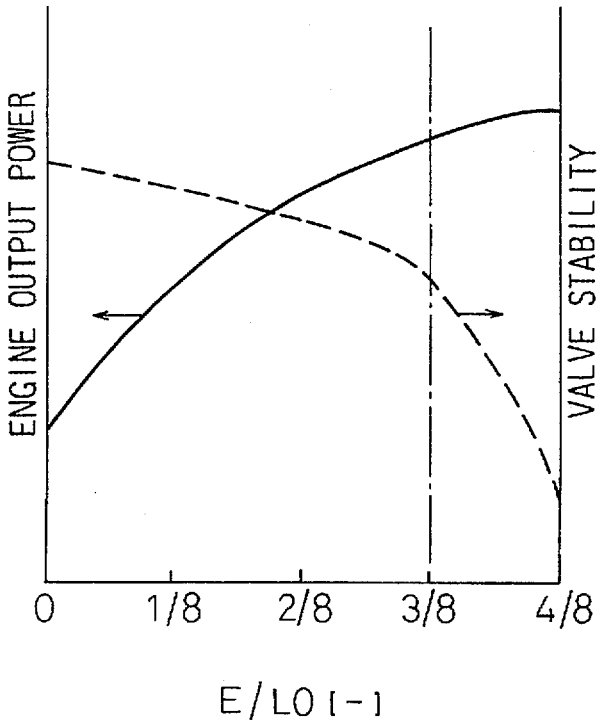
FIG. 7 illustrates changes in an engine output power and a stability of the butterfly valve when the ratio E/L0 changes.

FIG. 7 shows changes in an engine output power and the stability of the butterfly valve 16 when a ratio E/L0 changes, where E is the eccentricity, and L0 is a projected length of the valve element 21 on a projected plan substantially perpendicular to the pipe axis K—K (see FIG. 3). As the ratio E/L0 becomes larger, a pressure receiving area of the bottom part 21*a* becomes larger and that of the top part 21*b* becomes smaller, and the valve opening force becomes larger. As a result, the maximum valve opening becomes larger when the ratio E/L0 becomes larger, and therefore, the engine output power becomes larger when the ratio E/L0 becomes larger, as shown in FIG. 7.

On the other hand, as the ratio E/L0 becomes larger, namely as the area of the top part 21*b* becomes smaller, the valve closing force due to the exhaust gas pressure acting on the valve element 21 becomes smaller. Note that, in a butterfly valve as in the present invention, the valve opening force acting on the bottom part 21*a* and the valve closing force acting on the top part 21*b* balances, to thereby prevent a chattering of the valve 16 due to changes in the exhaust gas flow. Thus, if the ratio E/L0 is made larger and the area of the top part 21*b* is made smaller, chattering may occur easily and the stability of the valve 16 may deteriorate.

To keep the engine output power as large as possible, and the valve stability as good as possible, the eccentricity E is selected so that the ratio E/L0 satisfies the following inequality:

$$0<E/L0\leqq 3/8$$

The angle ALPHA is selected to satisfy the following inequality:

$$0<\text{ALPHA (deg)}\leqq 90$$

However, if the angle ALPHA is small, the dimensions of the butterfly valve 16 becomes large, and an angle formed by the valve element 21 and the exhaust gas flow becomes small. Therefore, the angle ALPHA (deg) is preferably selected within a range between about 60 and about 70, in an actual application.

The angle BETA is selected to satisfy the following inequality:

$$0<\text{BETA (deg)}\leqq 50$$

The dimensions of the valve element 21 are selected so that the valve 16 does not collide with the inner wall of the valve body 17. However, if the angle BETA is large, while preventing the valve element 21 from colliding with the valve body 17, a large clearance is formed between the edge 27 and the valve body 17 when the valve 16 is in the closed position. Such a large clearance allows a leakage of the exhaust gas, even when the valve 16 is closed. This prevents the booming noise from being reduced sufficiently. Therefore, the angle BETA is selected to satisfy the above inequality and is preferably 45 (deg).

The projected distance L1 between the edge 32 of the top part 21*b* and the pleat line 26 is selected to satisfy the following inequality:

$$1/2\leqq L1/L0\leqq 3/4$$

It has been found that if L1/L0 is smaller than ½, a larger clearance is formed when the valve is in the closed position, as mentioned above. Also, it has been found that if L1/L0 is larger than ¾, the area of the tip portion 27 becomes smaller, to thereby decrease the valve opening force acting on the valve element 21, and it becomes difficult to ensure the larger engine output power. Therefore, the projected distance L1 is selected to satisfy the above inequality.

Figure 8A:
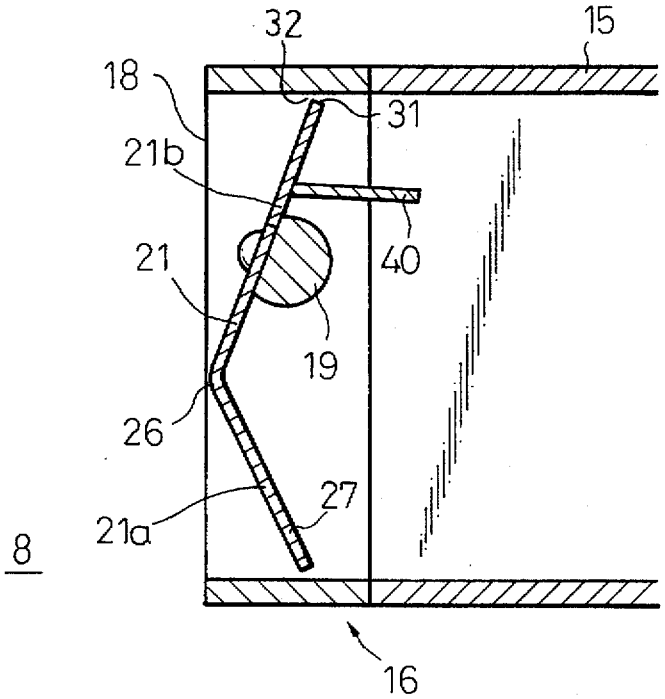
FIGS. 8A and 8B show an operation of a butterfly valve according to a second embodiment of the present invention.
Figure 8B:
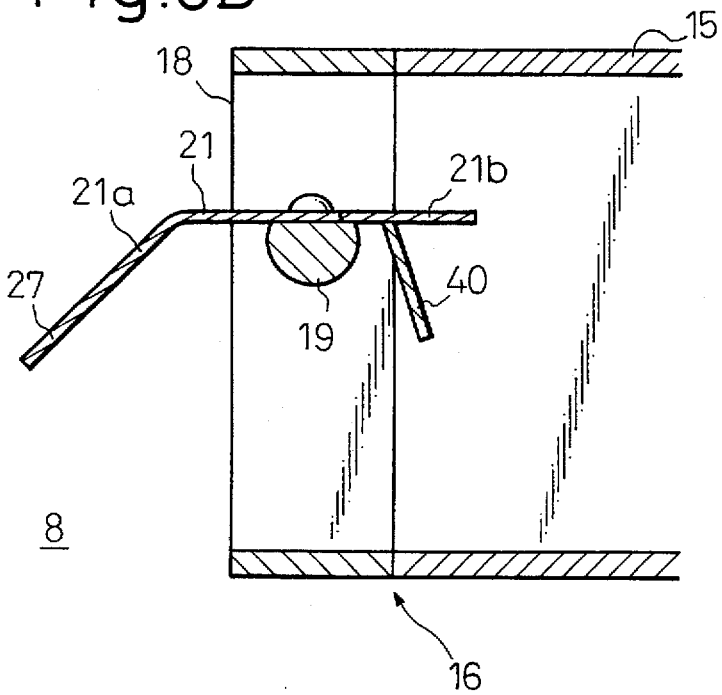

FIGS. 8A and 8B illustrate a second embodiment of the present invention.

Referring to FIGS. 8A and 8B, the top part 21*b* has a tip portion 40 bent toward the upstream of the exhaust gas flow. The tip portion 40 is formed by a different member from the valve element 21, and is integrally fixed to the top part 21*b*. The edge of the top part 21*b* is arranged to obtain the smaller clearance 32. Alternatively, the tip portion 40 may be formed in one piece with the top part 21*b* by bending the top part 21*b* along an additional pleat line substantially parallel to the shaft axis, while the clearance 32 is made smaller.

In the second embodiment, the angle formed by the tip portion 40 and the exhaust gas flow becomes larger, as the opening of the butterfly valve 16 becomes larger. Therefore, the larger valve opening force is obtained by the dynamic pressure acting on the tip portion 40, even when the valve opening is relatively large. Further, when the valve opening is relatively large, the tip portion 40 is positioned below the valve shaft 19, as shown in FIG. 10. This results in making the maximum valve opening of the valve 16 larger than that in the embodiment shown in FIG. 1. The other construction and operation are the substantially same as those of the embodiment explained with reference to FIG. 1, and thus, the explanations thereof are omitted.

According to the present invention, it is possible to provide a butterfly valve which has a low flow resistance, but is prevented from opening too quickly, when the gas pressure increases quickly.

While the invention has been described by reference to specific embodiments chosen for purposes of illustration, it should be apparent that numerous modifications could be made thereto by those skilled in the art without departing from the basic concept and scope of the invention.

I claim:

1. A butterfly valve adapted to be arranged in a pipe through which fluid can flow, the pipe having an axis and an outlet end, the valve comprising:

a valve shaft having an axis eccentric to the pipe axis; and a valve element integrally supported by the valve shaft, wherein the valve is opened by a fluid pressure acting on the valve element, wherein a part of the valve element on one side of the valve shaft has a tip portion bent along a pleat line substantially parallel to the shaft axis toward an upstream side of a fluid flow, and wherein the valve is arranged at the outlet end of the pipe to form a clearance between the valve element part around the pleat line and the outlet end of the pipe, to thereby allow the fluid to flow out through the clearance, when the valve opens from a closed position thereof.

2. A butterfly valve according to claim 1, wherein the shaft axis is substantially perpendicular to the pipe axis.

3. A butterfly valve according to claim 1, wherein the valve element part having the tip portion is on the pipe axis side relative to the valve shaft.

4. A butterfly valve according to claim 1, wherein the tip portion and the valve element are formed in one piece.

5. A butterfly valve according to claim 1, wherein the valve further comprises biasing means for biasing the valve toward the closed position thereof.

6. A butterfly valve according to claim 1, wherein a distance between the shaft axis and the pipe axis E and a projected length of the valve element L0 in a direction perpendicular to the shaft axis has the following relationship:

$$0<E/L0\leqq 3/8.$$

7. A butterfly valve according to claim 1, wherein the valve element except for the tip portion and the pipe axis forms an angle ALPHA, when the valve is closed, the angle ALPHA being selected by the following inequality:

$$0<\text{ALPHA (deg)}\leqq 90.$$

8. A butterfly valve according to claim 7, wherein the angle ALPHA (deg) is selected within a range from about 60 to about 70.

9. A butterfly valve according to claim 1, wherein the valve element part and the tip portion forms an angle BETA, the angle BETA being selected by the following inequality:

$$0<\text{BETA (deg)}\leqq 50.$$

10. A butterfly valve according to claim 9, wherein the angle BETA (deg) is about 45.

11. A butterfly valve according to claim 1, wherein a projected length of the valve element L0 and a projected distance between the pleat line and a tip of the valve element which is on the opposite side of the tip portion relative to the valve shaft, has the following relationship:

$$1/2\leqq L1/L0\leqq 3/4.$$

12. A butterfly valve according to claim 1, wherein a projected plan of the valve element has a substantially rectangular configuration.

13. A butterfly valve according to claim 1, the valve further comprising a valve body for supporting the valve shaft, wherein the valve body is attached to the outlet end of the pipe.

14. A butterfly valve according to claim 1, wherein another valve element part has a tip portion bent toward the upstream side of the fluid flow.

15. A silencer, for an engine having an exhaust pipe, comprising:

a first chamber adapted to be connected to the exhaust pipe of the engine;

a second chamber connected to an atmosphere;

a first connection pipe for connecting the first and the second chambers each other, the first pipe having an axis and an outlet end;

a second connection pipe for connecting the first and the second chambers each other, different from the first pipe;

a butterfly valve arranged in the first pipe, comprising:

a valve shaft having an axis eccentric to the pipe axis; and a valve element integrally supported by the valve shaft, wherein the valve is opened by an exhaust gas pressure acting on the valve element, wherein a part of the valve element on one side of the valve shaft has a tip portion bent along a pleat line substantially parallel to the shaft axis toward an upstream side of an exhaust gas flow, and wherein the valve is arranged at the outlet end of the first connection pipe to form a clearance between the valve element part around the pleat line and the outlet end of the first connection pipe to thereby allow an exhaust gas to flow out through the clearance when the valve opens from a closed position thereof.

16. A silencer according to claim 15, wherein the flow area of the first pipe is larger than that of the second pipe.

17. A silencer according to claim 15, wherein the first chamber comprises an expansion chamber and a resonance chamber connected to each other, wherein an outlet end of the exhaust pipe of the engine is arranged in the expansion chamber, and wherein an inlet end of the first pipe is arranged in the resonance chamber.

18. A silencer according to claim 15, further comprising at least one additional chamber between the first and the second chambers, wherein the chambers are connected to each other in series.

19. A silencer according to claim 15, further comprising keeping means for keeping the valve closed when an engine load is low.

* * * * *

UNITED STATES PATENT AND TRADEMARK OFFICE

CERTIFICATE OF CORRECTION

PATENT NO. : 5,709,241

DATED : January 20, 1998

INVENTOR(S) : Minoru IWATA

It is certified that error appears in the above-indentified patent and that said Letters Patent is hereby corrected as shown below:

Column 1, line 17, before "each" insert --to--.

Column 4, line 16, delete "the".

Column 4, line 45, delete "of".

Column 5, line 47, delete "in".

Column 6, line 31, change "becomes" to --become--.

Column 8, line 41, before "each" insert --to--.

Column 8, line 44, before "each" insert --to--.

Signed and Sealed this

Twentieth Day of October, 1998

*Attest:*

*Attesting Officer*

BRUCE LEHMAN

*Commissioner of Patents and Trademarks*